United States Patent [19]

Davet

[11] 4,300,674

[45] Nov. 17, 1981

[54] ANTI-THEFT FINGER RING DISPLAY DEVICE

[75] Inventor: Richard F. Davet, Beachwood, Ohio

[73] Assignee: Ringo Manufacturing Co. Inc., Cleveland, Ohio

[21] Appl. No.: 113,527

[22] Filed: Jan. 21, 1980

[51] Int. Cl.[3] ..... B65D 1/34; E05B 73/00

[52] U.S. Cl. ..... 206/45.14; 206/1.5; 70/63; 211/4; 206/565; 206/566

[58] Field of Search ..... 206/45.14, 1.5, 565, 206/566; 70/63; 211/4

[56] References Cited

U.S. PATENT DOCUMENTS

| | | | |
|---|---|---|---|
| 2,250,433 | 7/1941 | Dean | 206/45.14 |
| 3,204,774 | 9/1965 | Barbieri | 206/566 |
| 3,419,728 | 12/1968 | Wilson | 211/4 |
| 3,964,603 | 6/1976 | Sandler | 206/566 |

FOREIGN PATENT DOCUMENTS

| | | | |
|---|---|---|---|
| 15684 | of 1913 | United Kingdom | 206/1.5 |

*Primary Examiner*—Herbert F. Ross

*Attorney, Agent, or Firm*—Wilkinson, Mawhinney & Theibault

[57] ABSTRACT

The object of the invention is to provide an individual setting for displaying finger rings similar to finger ring boxes but which prohibits unauthorized withdrawal of the ring from the display.

The finger ring supports are wedge-shaped and are secured to a main support surface. Each wedge-shaped support has a transverse slot to receive the closed loop portion of a finger ring and a bore from the base side of the wedge extending beyond the transverse slot slidably accommodates a magnetically attractable ring locking member which passes through the closed looped portion of the finger ring and the ring locking means can only be removed from the bore by a magnet, the ring not being removable from the support without a magnet and the point to place the magnet not being visible by the observer or prospective purchaser.

4 Claims, 6 Drawing Figures

ANTI-THEFT FINGER RING DISPLAY DEVICE

TECHNICAL FIELD

My invention relates to ring display devices in which the rings are displayed in a ring-box like setting finger and are secured against (surreptitious) removal while permitting of either inclined or horizontal arrangement which may be stationary or rotary.

BACKGROUND ART

Heretofore ring display devices which have a security locking member passing through the closed loop of the finger ring have been of the multiple group type having spring biased locking members of the type shown in U.S. Pat. Nos. 507,864; 2,321,339; 3,204,774; 3,400,812 and 3,964,603 which are directed to multiple ring flat type either inclined or tiered but none directed to the finger ring box display concept wherein the axially removable ring loop securing member is removed from the ring loop magnetically or is retained in the ring secured position magnetically.

Magnetic controlled locking devices are shown in U.S. Pat. Nos. 3,736,779; 3,584,485 and 3,289,443 however none relate to a ring display or teach the combination claimed.

DISCLOSURE OF THE INVENTION

In accordance with my invention I provide a finger ring-like box display support which may be arranged individually or in clusters, positioned flat, or vertically inclined and be either stationary or rotated.

My improved finger ring box-like display support poses the advantage of retaining each ring in its slot in the ring support by an axially removable magnetically attractable shaft or plunger not viewable from the flat surface of the display which passes through the closed loop of the ring and which may be either retained magnetically or retained and magnetically withdrawn by the shopkeeper with a magnet not requiring a special key.

BEST MODE FOR CARRYING OUT THE INVENTION

Figure 2:
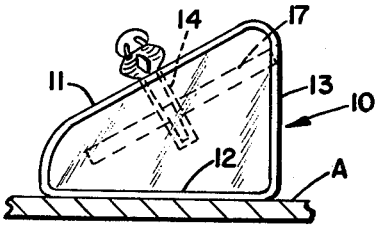
FIG. 2 is a vertical section through the ring box-like support of the present invention supporting a ring.
Figure 3:
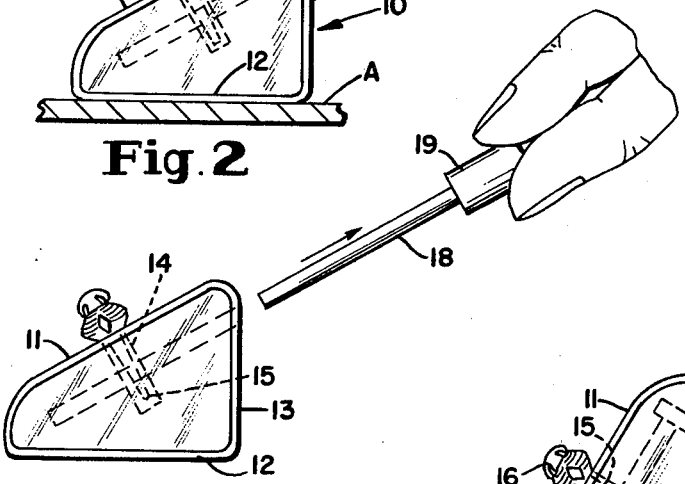
FIG. 3 is a view similar to FIG. 2 showing the ring retaining plunger or locking member being removed by a magnet.

Referring now to FIGS. 2 and 3 of the drawings, 10 designates a ring support resembling half of a ring box having, in longitudinal vertical section, a generally triangular wedge-like construction comprising a hypotenuse 11, base 12 and short side 13. The support may be of a solid non-magnetic material such as wood or plastic. A transverse slot 14 is made to receive the closed loop 15 of a finger ring 16. The support 10 has a bore 17 partially therethrough, at least beyond either side of the transverse slot 14, to slidingly receive a shaft or ring locking member 18 of magnetically attractable material such as iron or steel. A manually manipulatable magnet 19 is employed to remove the locking member 18 by the shopkeeper so that the ring 16 may only be removed from the ring support in his or her presence for close personal inspection by a prospective purchaser. This embodiment for either a horizontal or upwardly inclined display support A to which the base 12 of the ring support is secured so that the open end of the bore 17 in the base 12 is not viewable by the prospective purchaser.

When in the presence of the shopkeeper a prospective purchaser wishes to examine the ring, the shopkeeper places the magnet 19 at the open end of the bore 17 so that the magnet will attract the ring locking member 18 removing it axially of the bore 17 to clear the ring 16 and permit its removal from the transverse slot 14 in the support 10.

Figure 4:
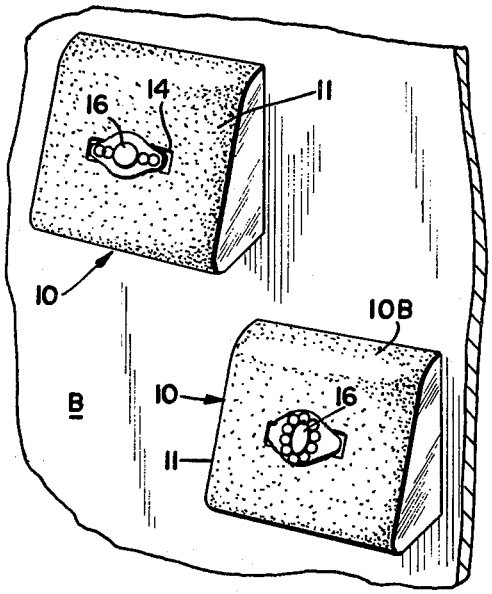
FIG. 4 is a view similar to FIG. 1 showing the box-like ring support devices secured to a vertical surface.
Figure 5:
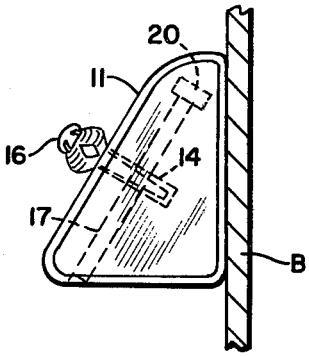
FIG. 5 is a vertical sectional-view of the form of device shown in FIG. 4 with the ring locking member in its locked position.
Figure 6:
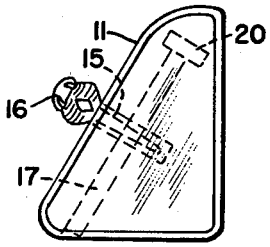
FIG. 6 is a view similar to FIG. 5 with the ring locking member being removed by a magnet.
Figure 6:
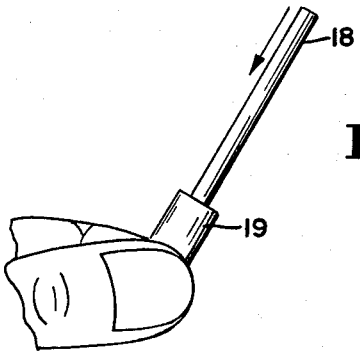

When associated with a vertical mounting surface B such as shown in FIGS. 4 and 5 the individual ring like support will be provided with an additional magnet 20 positioned at the end of the bore 17 to retain the ring locking member 18 in place against a gravity drop out. The magnet 20 must have sufficient magnetic strength to retain the member 18 in place against a gravity pull while the magnet 19 must have a strength to overcome the magnet 20 to remove the locking member 18.

Figure 1:
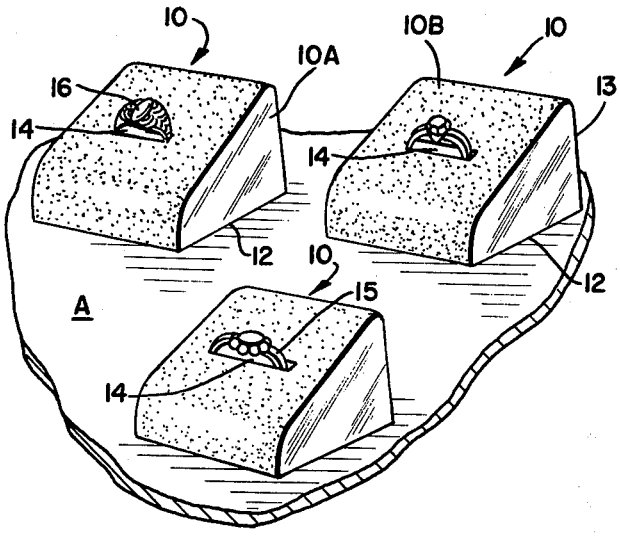
FIG. 1 is a perspective view through a horizontal or inclined sector of finger ring box-like display devices constructed in accordance with my invention.

In the embodiments shown in FIGS. 1 and 4, the wedge-shaped support members 10 have mirror ends 10A and the portion 10B is covered with velour or a similar plush material to closely resemble a ring box.

A triangle or other geometric configuration of support surfaces B may be mounted for rotation and selective viewing of the rings. The flat support surface A may be of the mirror type.

What I claim is:

1. An anti-theft finger ring display device comprising a wedge-shaped ring support member for each ring having a base side, short side and hypotenuse side, said hypotenuse side having a transverse slot therein proximate the mid-length thereof for receiving the closed loop portion of at least one finger ring, said wedge-shaped support having a bore for each ring entering the short side and extending beyond the transverse slot, a ring retaining member of magnetically attractable material for each ring slidably receivable within said bore and extending from said short side to a point beyond said transverse slot adapted to pass through the closed loop portion of each finger ring to assure against unauthorized removal of the ring from said support, and magnetic means for attracting and axially withdrawing said ring retaining member from said support to permit authorized removal of said ring from said support.

2. An anti-theft finger ring display device as claimed in claim 1 further comprising a second magnet positioned at the end of the bore to retain the ring retaining member against disassociation from said wedge-like support by gravity.

3. An anti-theft finger ring display device as claimed in claim 1 wherein the base side of said wedge is secured to a display surface for a plurality of ring support members.

4. An anti-theft finger ring display device as claimed in claim 2 wherein a plurality of said wedge-like ring supports are secured to a display support surface with the apex of said wedge directed upwardly with the bore opening in the short side out of view of an observer.

* * * * *